US005897002A

United States Patent [19]

Carlino

[11] Patent Number: 5,897,002

[45] Date of Patent: Apr. 27, 1999

[54] TOOL HANGING RACK

[76] Inventor: Sam Carlino, 14288 Old Hwy. 80, El Cajon, Calif. 92021

[21] Appl. No.: 08/858,600

[22] Filed: May 19, 1997

Related U.S. Application Data

[63] Continuation-in-part of application No. 08/718,121, Sep. 18, 1996, abandoned.

[51] Int. Cl.[6] ..... A47F 5/00

[52] U.S. Cl. ..... 211/70.6; 211/94.01; 211/106; 211/59.1

[58] Field of Search ..... 211/94.01, 57.1, 211/59.1, 106, 70.6

[56] References Cited

U.S. PATENT DOCUMENTS

| | | | |
|---|---|---|---|
| 2,527,713 | 10/1950 | Dunn | 211/106 X |
| 3,297,290 | 1/1967 | Patterson | 211/59.1 X |
| 4,094,415 | 6/1978 | Larson | 211/57.1 |
| 4,308,961 | 1/1982 | Kunce | 211/94.01 |

*Primary Examiner*—Robert W. Gibson, Jr.

*Attorney, Agent, or Firm*—Douglas A. Burcombe

[57] ABSTRACT

A tool hanging rack for attaching to a verticle surface consists of an elongated member forming a C-shaped channel and one or more tool hanger assemblies consisting of one or more nuts which can slide within the C-shaped channel and one or more support rod base plates which can be connected to the nuts by bolts or screws and tighted securely against the elongated member at desired positions along the channel so when the tool hanging rack is fastened to a verticle wall, the support rods are angled upwards and can support tools or other objects. In a second embodiment, the tool hanger assembly comprises a base plate having a front and back surface and a support rod secured at an angle to the front surface. The base plate is manufactured just small enough to slide within the channel of the elongated member with the support rod extending through the front wall opening. By applying downward pressure on the support rod, the base plate can be wedged against the inside of the channel such that the tool hanger assembly resists lateral movement and the support rod is angled slightly upward when the tool hanging rack is attached to a wall. The base plate and support rod of the second embodiment can be formed in one peice by bending a rod.

3 Claims, 5 Drawing Sheets

TOOL HANGING RACK

This application is a continuation-in-part of Ser. No. 08/718,121, filed Sep. 18, 1996, now abandoned.

BACKGROUND OF THE INVENTION

This invention relates to a tool hanging rack that can be attached to a wall. Historically, many different methods and apparatuses have been developed and utilized to hang tools and other various objects from vertical walls. The simplest form of tool hanger can involve nails banged into a wall wherein a tool (or another object such as a hat or extension cord) can be hung on the nail. In U.S. Pat. No. 5,097,966, an improved hanger system is disclosed in which a number of support rods can be inserted into holes bored at different positions along an elongated base member such that when the base member is attached to a wall, the support rods extend upwardly. In U.S. Pat. No. 5,499,724, a similar tool hanging rack is disclosed wherein support rods are mounted in holes bored at right angles to an elongated base member and the base member itself is adapted to mount at an acute angle to the wall. When the base member is attached to the wall, the support rods are thus angled upward. In both inventions it is possible to locate the support rods at different positions along the elongated member, however, the location of support rods is fixed depending on the location of the bores. Further, in both inventions, the support racks are designed to operate only when the elongated base member is mounted to a wall with its axis of elongation horizontal. The present invention overcomes both problems by providing a support rack that allows for infinite positioning of the support rods along the entire axis of elongation of the base member. Further, in one embodiment, the support rack is adapted to be operable when the elongated base member is mounted to a wall either horizontally or vertically.

SUMMARY OF THE INVENTION

A tool hanging rack for attaching to a vertical surface consists of an elongated member forming a C-shaped channel and one or more tool hanger assemblies which can be fastened at different positions along the elongated member. Each tool hanger assembly consists of a support rod or rods welded to a base plate, a nut which can slide within the C-shaped channel of the elongated member and a bolt or screw which can be used to connect the nut and base plate together permitting the hanger assemblies to be securely tightened against the elongated member at desired positions along the channel so that the support rods are angled upwards to support tools or other objects when the tool hanging rack is attached to a wall.

In a second example, the tool hanger assembly comprises a base plate having a front and back surface and a support rod secured at an angle to the front surface. The base plate is manufactured just small enough to slide within the channel of the elongated member with the support rod extending through the front wall opening. By applying downward pressure on the support rod, the base plate can be wedged against the inside of the channel such that the tool hanger assembly resists lateral movement and the support rod is angled slightly upward when the tool hanging rack is attached to a wall.

In a third example, the tool hanger assembly is comprised of a base plate and support rods formed by bending an iron rod. In this example, the rod is bent to form an M-shaped base plate portion that will slide within the channel of the elongated member with the support rods extending at right angles from the base plate portion through the channel opening. As described in the previous example, downward pressure can be applied to the support rods causing the base plate to wedge against the inside of the channel such that the tool hanger assembly resists lateral movement and the support rods are angled slightly upward when the tool hanging rack is attached to a wall. This example is the preferred embodiment due to the simplicity of manufacture and the reduction of parts.

DETAILED DESCRIPTION OF THE INVENTION

EXAMPLE 1

Figure 1:
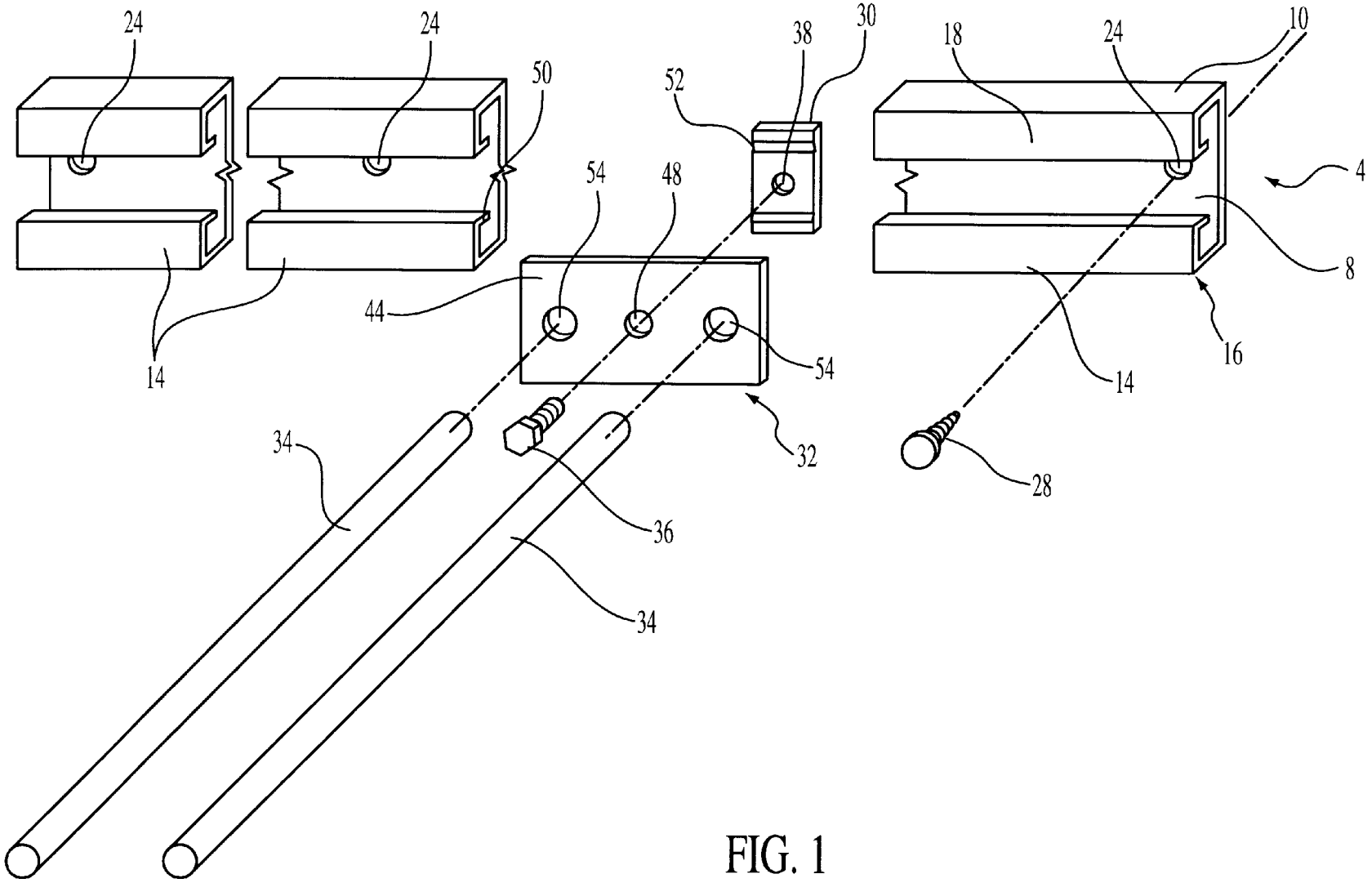
FIG. 1 is an exploded perspective view of the tool hanging rack of Example 1 showing the tool hanger assembly in positional relationship to the elongated member.

Referring to FIG. 1, an exploded perspective view of the tool hanging rack is shown indicating the individual components of the invention in positional relationship to each other. The individual components include the elongated member 4 and the tool hanger assembly 6.

Figure 2:
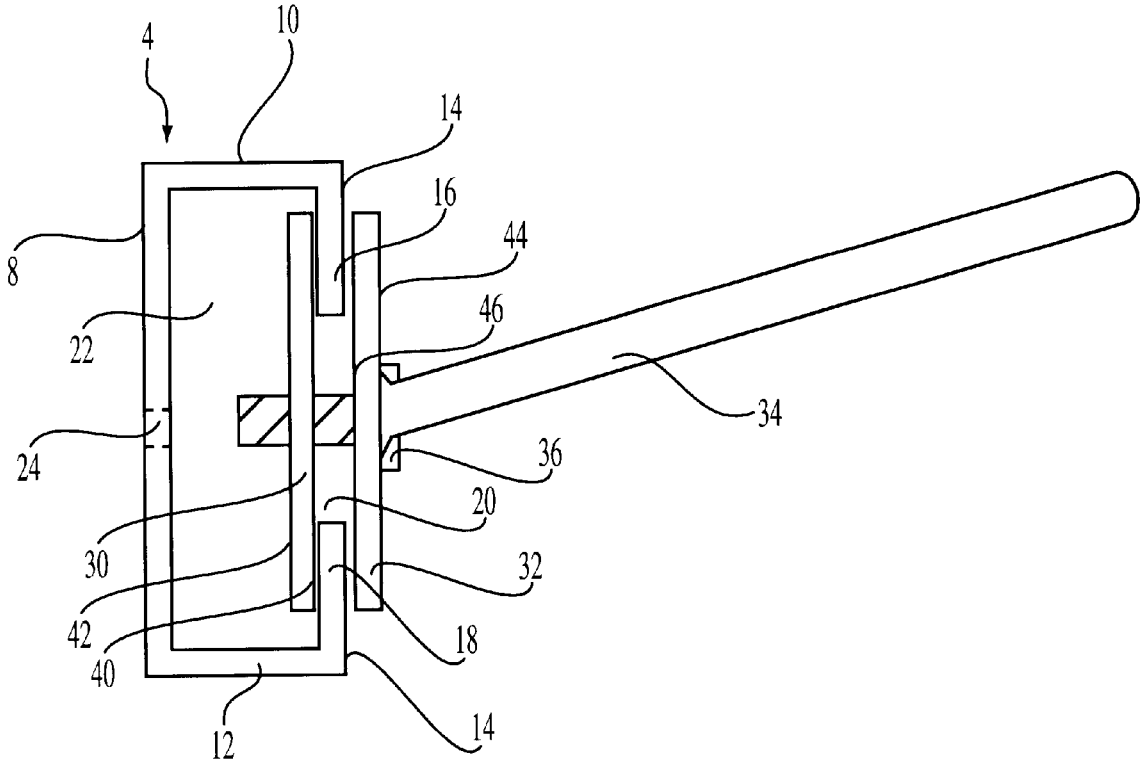
FIG. 2 is an end view of the tool hanging rack of Example 1.

With reference to FIG. 2, the elongated member 4 can be formed in one piece as a rectangular hollow member comprising a back wall 8, a top wall 10, a bottom wall 12, and a front wall 14. The elongated member can be cut to any desired length. The front wall 14 is not continuous but consists of a first and second flange 16, 18 displaced apart and opposite each other so that the flanges define an opening 20 through said front wall whereby said elongated member thus forms an elongated C-shaped channel 22.

Figure 3:
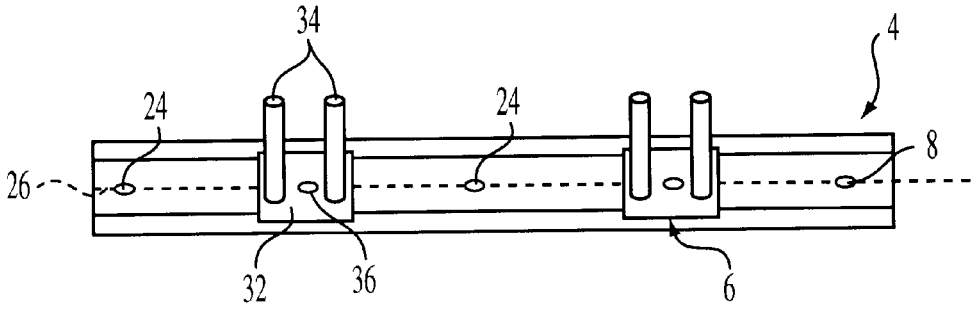
FIG. 3 is a front view of the tool hanging rack of Example 1 showing two hanger assemblies.

Mounting holes 24 are provided along the axis of elongation 26 of the back wall 8 such that the mounting holes are centrally aligned with the front wall opening, FIG. 3, and thus accessible through the front wall opening 20. With reference to FIG. 1, the mounting holes are spaced preferably at 16 or 24 inches so that the holes are aligned with the joists in a wall and screws 28 used to fasten the elongated member to a wall will engage the joists when the screws are inserted through the mounting holes and tightened down.

The mounting holes can be drilled, die cut or formed during manufacture of the elongated member. The elongated member can be cast in one piece or assembled from plates.

With reference to FIG. 1, the tool hanger assembly consists of three components, a nut 30, a base plate 32 with support rods 34 and a bolt or screw 36. The nut has a threaded bore 38 for receiving the bolt or screw 36. The bore passes through the nut entering the front surface of the nut 40 and exiting the back surface 42. In the preferred embodiment, the nut is rectangular in shape and sized so that the front surface or shoulder of the nut is wider (see FIG. 2) than the opening 20 defined by the flanges 16, 18 of the front wall 14 of the elongated member 4 and thinner than the depth of the channel 22 formed by the elongated member 4 so the nut can slide within the channel of the elongated member.

In the preferred embodiment, the base plate 32 is formed as a rectangular flat plate having a front 44 and back surface 46 and proportionately sized or dimensioned so that the base plate 32 is wider (see FIG. 3) than the opening 20 defined by the flanges 16, 18 of the front wall 14 of the elongated member 4. The base plate 32 is provided with a smooth bore 48 for slidably receiving a bolt or screw 36. The bore 48 is drilled or formed at right angles to the plate 32 and passes through the plate entering through the front surface 44 and exiting the back surface 46 of the base plate. A bolt or screw 36 is designed to pass through the smooth bore of the base plate and engage the nut 30 when the nut is positioned in the C-shaped channel 22 of the elongated member 4. When the bolt or screw is tightened down, the base plate and nut are pulled towards each other so the front surface 40 of the nut 30 and the back surface 46 of the base plate 32 are compressibly locked against the front wall flanges 16, 18 of the elongated member 4 at a predetermined position. The nut may be formed with grooves 52 (FIG. 1) for accepting ridges 50 which extend inwardly from the flanges 16, 18 of the front wall 14 towards the channel 22. When the base plate is tightened down against the nut, the ridges 50 extending inwardly from the flanges will interlock with the grooves 52 of the nut 30 further preventing slipping of the nut within the channel of the elongated member when the nut and base plate are compressibly tightened against the front wall 14 of the elongated member 4.

In a preferred embodiment, two support rods 34 are made of galvanized metal and are welded to the base plate 32 at a supportive angle and positioned apart from each other on each side of the smooth bore 48 in parallel alignment with each other, FIG. 3 and FIG. 2 (a supportive angle is any angle that is not downward sloping). It is contemplated that the support rods could also be bolted, welded or threaded into the base plate at right angles to the base plate and then bent to the correct angle if so desired. In the embodiment shown in FIG. 1, smooth bores 54 would be provided in the base plate 32 for accepting the support rods. The support rods 34 would be inserted in the smooth bores 54 and then butt welded to the base plate at the back surface 46 of the base plate 32. The length of the support rods can be varied so as to accommodate different objects. In one embodiment, the spacing of the support rods is wide enough to accommodate the handle of a shovel between them whereby the shovel head would rest upon the support rods when the handle is suspended downward between the support rods and the elongated member 4 is fastened to a wall with its axis of elongation 26 lined up with the horizontal. When necessary, the base plate can be manufactured with only one support rod to accommodate particular objects.

In the preferred embodiment, the elongated member 4 is attached to a wall with its axis of elongation 26 aligned with the horizontal. When the elongated member is so attached the support rods would extend out from the elongated member at a slightly upward angle so as to prevent an article that is hung on the support rod from sliding off (FIG. 3). In the preferred embodiment, the support rods will be angled upward but the rods could extend horizontally as well.

In a second embodiment, the elongated member can be mounted to a wall with its axis of elongation parallel with vertical. In the second embodiment the support rods would be mounted to the base plate so as to extend upwardly when the base plate is secured to the vertically mounted elongated member. In both embodiments, it is contemplated that the same base plate/support rod component can be used without modification.

EXAMPLE 2

Figure 4:
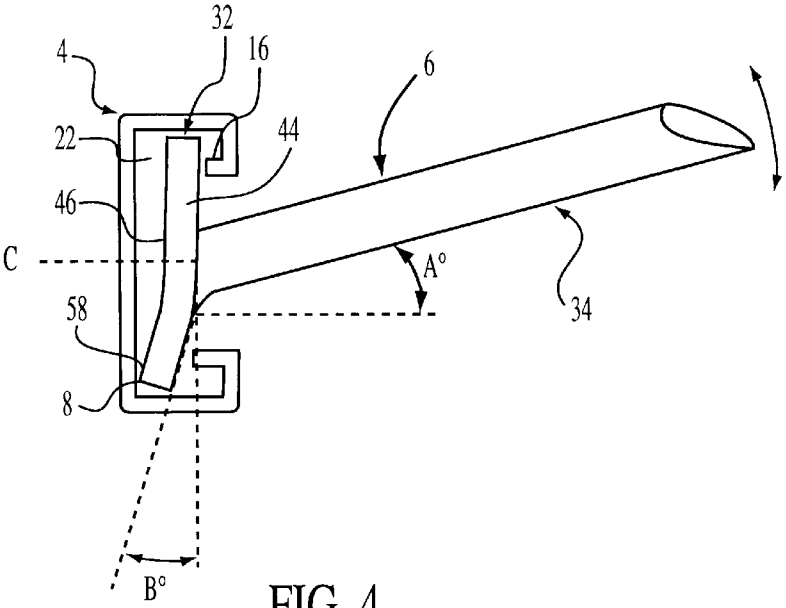
FIG. 4 is an end view of the tool hanging rack of Example 2.

In this example the elongated member is manufactured exactly the same as described in Example 1. The tool hanger assembly is manufactured differently. With reference to FIG. 4, the tool hanger assembly 6 consists of only the base plate 32 and support rod 34 or support rods. In the preferred embodiment, the tool hanger assembly 6 is made of metal and manufactured as a single piece in that the support rods 34 are welded to the base plate 32 as described in Example 1.

Figure 6:
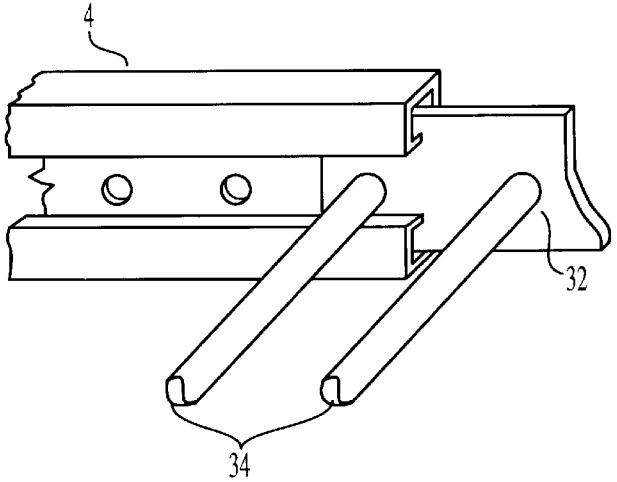
FIG. 6 is a perspective view of the tool hanging rack of Example 2.
Figure 5:
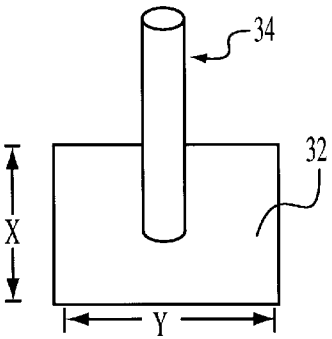
FIG. 5 is a front view of the tool hanger assembly of Example 2.

The base plate 32 is rectangular in shape as shown in FIG. 5 and dimensioned or sized as follows: the height (x) of the base plate is made slightly less than the height of the channel of the elongated member so that the base plate can easily slide into the channel. The length (y) of the base plate is made long enough to prevent the base plate from rotating when the base plate is confined within the channel of the elongated member 4. The thickness of the base plate must be less than the depth of the channel of the elongated member. When so dimensioned, the base plate 32 can be slid into the end of the channel and slid along but not pulled past the channel opening (see FIG. 6).

Figure 8A:
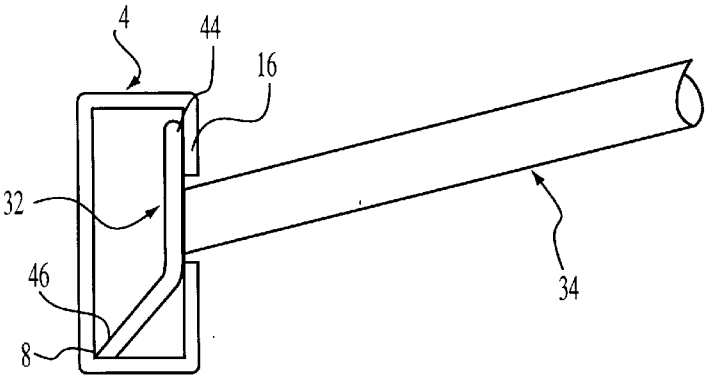
FIGS. 8A through 8E are end views of tool hanging racks showing different base plate designs for the tool hanger assemblies of Example 2.
Figure 8B:
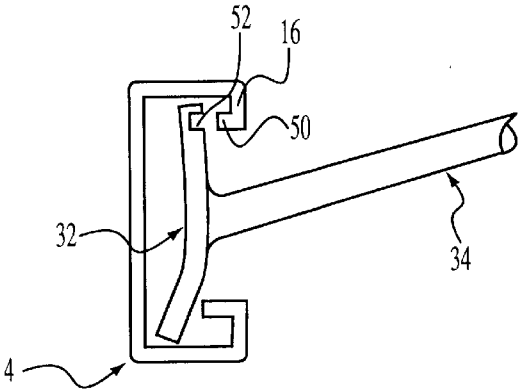
Figure 8C:
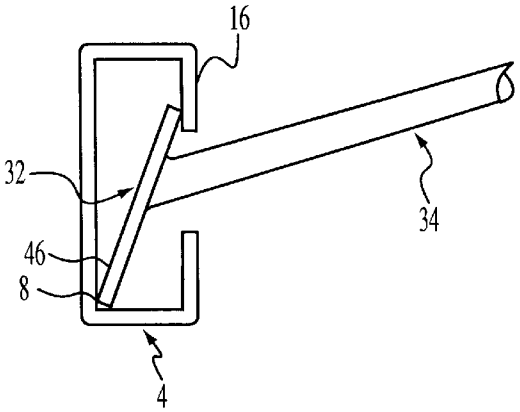
Figure 8D:
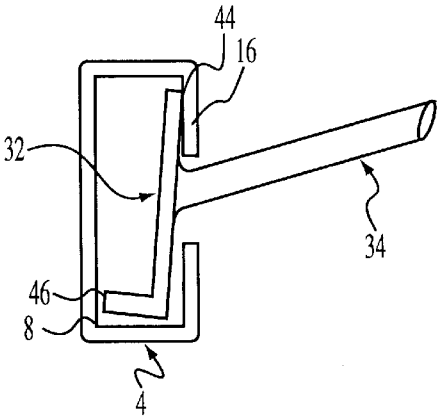
Figure 8E:
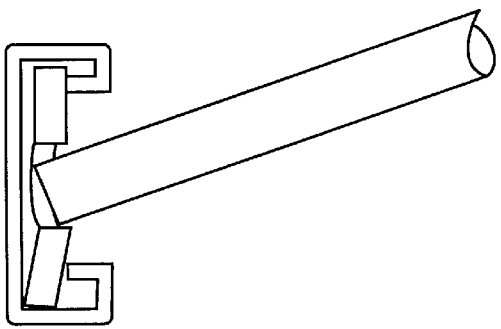

With reference to FIG. 4, the base plate 32 is fashioned from a single piece of metal and the support rod 34 is welded to the center line C of the base plate. As shown in FIG. 1 and FIG. 8E, smooth bores 54 would be provided in the base plate 32 for accepting the support rods. The support rods 34 would be inserted in the smooth bores 54 and then butt welded to the base plate at the back surface 46 of the base plate 32. It is possible that the support rod could be bolted to the base plate or threaded onto the base plate as an alternative embodiment. With reference to FIG. 4, the support rod 34 would be secured to the base plate 32 at angle A so that the support rod has a slight upward angle when the base plate is slid into the channel. The lower half of the base plate 32 is bent back at an angle B such that the base plate 32 can still rock back and forth within the channel 22 when the support rod 34 is moved up and down.

Referring again to FIG. 4, a number of different angles are possible with respect to the bend in the base plate (angle B) and the supportive angle at which the support rod is secured to the base plate (angle A). The determination of the angles is subject to the following limitation: when a downward force is applied to the support rod 34, the front surface 44 of the upper half of the base plate 32 must contact the inside surface of the upper flange 16 and the bottom edge 58 of the base plate 32 must contact the back wall 8 of the elongated member 4 thus locking the base plate 32 in position. In this locked position, angle A must be such that the support rod 34 will have a slight upward slope sufficient to prevent any article that is suspended from the support rod from slipping off when the tool hanging rack is fastened to a vertical wall or substrate (it is contemplated that the support rod could be secured such that it would extend out at a horizontal angle but an upward angle is desirable). If the upward pressure is applied to the support rod 34, angles A and B must be such that the base plate will dislodge from the locked position so that the hanger assembly can be slid to a new position.

The base plate 32 can be manufactured in a number of different shapes and configurations and still achieve the same result. The only limitations in determining the construction of the base plate 32 is that the base plate 32 must be sized such that it can be slidably confined within the elongated member 4 and shaped such that the base plate will wedge itself against the inside of the channel when downward pressure is applied to the support rod 34 secured to the base plate 32. Some variations on base plate design are shown in FIGS. 8A through 8E and are exemplary of some of the base plates intended to fall within the scope of the claims.

EXAMPLE 3

Figure 9A:
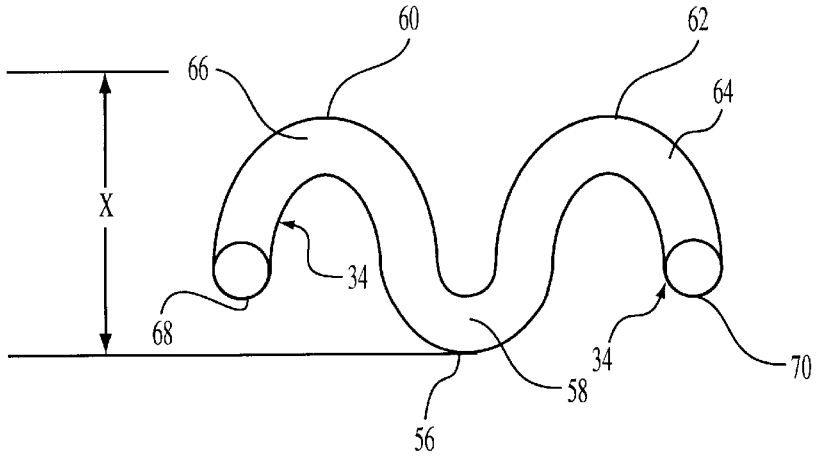
FIG. 9A is a front view of the tool hanger assembly of Example 3 comprising a base plate and two support rods.
Figure 9B:
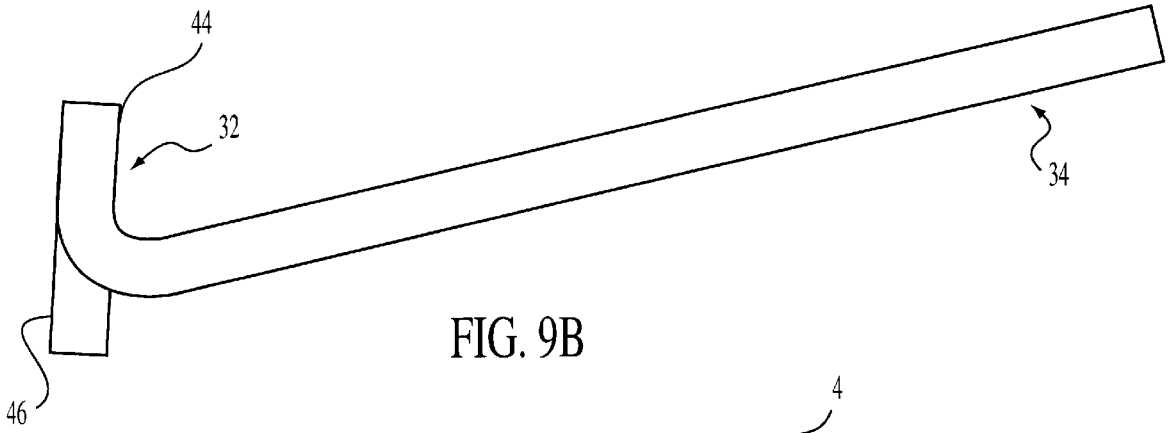
FIG. 9B is a side view of the tool hanger assembly of Example 3.
Figure 9C:
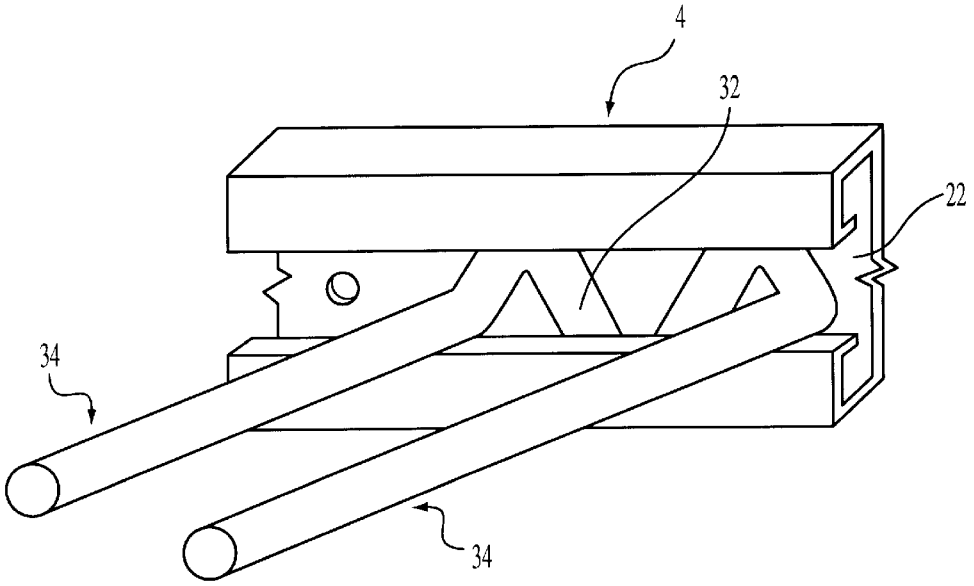
FIG. 9C is a perspective view of the tool hanger assembly of Example 3 in positional relationship to the elongated member.

In this example, the elongated member is manufactured exactly the same as described in Example 1. The hanger assembly is formed from a single rod and bent as shown in FIGS. 9A, 9B and 9C. With respect to FIG. 9A, the rod, terminating in a first and second end 34, is bent in a first step in the shape of a V. In second step, the two ends of the rod are bent in the opposite direction so the rod forms an M lying flat in one plane. The criteria for determining the point at which the bends should occur is as follows: both rod ends are bent such that the distance (x) between the lowermost part 56 of the center leg of the M 58 and the uppermost part 60, 62 of the shoulders of the two flanking legs 64 and 66 is slightly less than the distance between the top and bottom of the channel formed inside the elongated member. In a third step, the rod ends comprising the two flanking legs 64,66 are bent away from the plane of the M formed by the bent rod at slightly more than right angles to the plane of M and parallel to each other as shown in FIG. 9B.

With reference again to FIG. 9A, The rod ends are bent such that the distance between the lowermost part of the bends 68,70 and the uppermost part 60,62 of the shoulders of the two flanking legs 64, 66 is about half of distance (x) such that the center leg 58 becomes the longest leg of the M-shaped portion of the bent rod. With reference to FIGS. 9B and 9C, it can be seen that the two ends of the rod bent at right angles to the plane of the M comprise the support rods 34 of the hanger assembly and the M shaped portion comprises the base plate 32. The distance between the two support rods is made greater than the distance between the top and bottom of the channel formed inside the elongated member. Bent in this way, the M-shaped base plate portion is thus dimensioned to slide without rotating within the channel formed by the elongated member with the support rod portions extending through the channel opening at a slight upward angle in parallel lateral displacement (see FIG. 9C). When the base plate is slid into the channel and downward pressure is exerted against the two support rods, the front face 44 of the two outer legs of the M-shaped base plate are forced against the inside of the top front wall of the channel and the middle leg of the M-shaped base plate is forced against the inside of the bottom of the rear wall of the channel so that the hanger assembly is wedged in the channel (see FIG. 9C). In the wedged position, the support rods will extend with a slight upward slope sufficient to prevent any article that is suspended from the support rods from slipping off when the tool hanging rack is fastened to a vertical wall or substrate (it is contemplated that the support rod could be secured such that it would extend out at a horizontal angle but an upward angle is desirable).

Manufacturing the hanger assembly in this way eliminates the moving parts comprising the base plate nut and bolt of the first embodiment and avoids the need for welding parts as described in both of the previous embodiments. In the preferred embodiment, the rod is made of zinc plated metal or iron. It is contemplated that the iron rod could be bent in a number of configurations slightly different than the M shape described above and still retain the necessary functionality disclosed in the third example. One such example would comprise a hanger assembly where one end of the rod is bent to form a base plate having the required functionality and the other end of the end of the rod would extend from the channel opening as a single support rod.

Figure 7:
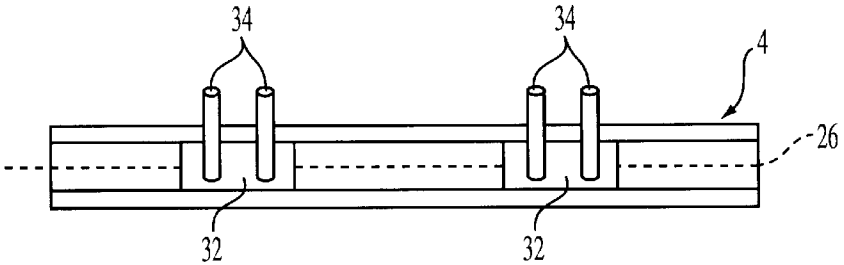
FIG. 7 is a front view of the tool hanging rack of Example 2 showing two tool hanger assemblies.

In the preferred embodiment, a number of tool hanger assemblies are provided. The tool hanger assemblies can be fastened at an infinite number of positions along the axis of elongation 26 of the elongated member 4 (FIG. 3 and FIG. 7).

In the preferred embodiment, all components of the invention are made of metal and designed to withstand the constant wear and tear of heavy tools being placed on and removed from the tool hanger assembly. It is possible to manufacture the invention in plastic and such a modification is contemplated but not preferred since the plastic parts would be subject to breakage when used for their intended purpose.

Since the principles of the invention have now been made clear, modifications which are particularly adapted for specific situations without parting from those principals disclosed herein will be apparent to those skilled in the art. The appended claims are intended to cover such modifications as well as the subject matter described and to be limited only by the true spirit of the invention.

I claim:

1. A tool hanging rack comprising:

(a) an elongated rectangular hollow member comprising a back wall, a top wall, a bottom wall, and a front wall, said front wall consisting of a first and second flange displaced apart and opposite each other so that said flanges define an opening through said front wall whereby said elongated member thus forms an elongated C-shaped channel, said elongated member further comprising a plurality of holes spaced along the axis of elongation of said back wall, said holes dimensioned to accept a fastening member for attaching said elongated member to a substrate; and, (b) a tool hanger which can be secured to said elongated member at any point along its axis of elongation wherein said tool hanger comprises an iron rod bent to form a base plate and two support rods, said base plate comprising an inner U-shaped member flanked by two inverted U-shaped members where said flanking U-shaped members terminate as support rods extending outward from said base plate at right angles to said base plate parallel with each other, the closed end of each U-shaped member forming a contact point and the length of the U formed by the inner member being longer than the length of the U formed by the flanking U-shaped members, said base plate being so dimensioned that said base plate can slide without rotating within the channel of said elongated member with the support rods extending through said front wall opening whereby downward pressure applied to said support rods will cause the base plate contact points to wedge inside the channel such that that lateral movement of the tool hanger is restricted and said support rod projects outward from the elongated member at a supportive angle when the elongated member is fastened to a vertical substrate.

2. A tool hanging rack as defined in claim 1 comprising a plurality of said tool hangers which can be secured at different positions along the axis of elongation of said elongated member.

3. A tool hanger for a tool hanging rack where said tool hanging rack comprises an elongated rectangular hollow member comprising a back wall, a top wall, a bottom wall, and a front wall, said front wall consisting of a first and second flange displaced apart and opposite each other so that said flanges define an opening through said front wall whereby said elongated member thus forms a C-shaped channel, said elongated member further comprising a plurality of holes spaced along the axis of elongation of said back wall, said holes dimensioned to accept a fastening member for attaching said elongated member to a substrate, said tool hanger comprising an an iron rod bent to form a base plate and two support rods, said base plate comprising an inner U-shaped member flanked by two inverted U-shaped members where said flanking U-shaped members terminate as support rods extending outward from said base plate at right angles to said base plate parallel with each other, the closed end of each U-shaped member forming a contact point and the length of the U formed by the inner member being longer than the length of the U formed by the flanking U-shaped members, said base plate being so dimensioned that said base plate can slide without rotating within the channel of said elongated member with the support rods extending through said front wall opening whereby downward pressure applied to said support rods will cause the base plate contact points to wedge inside the channel such that that lateral movement of the tool hanger is restricted and said support rod projects outward from the elongated member at a supportive angle when the elongated member is fastened to a vertical substrate.

* * * * *